US006877966B2

(12) United States Patent
Henderson

(10) Patent No.: US 6,877,966 B2
(45) Date of Patent: Apr. 12, 2005

(54) APPARATUS FOR INDICATING REMAINING LIFE EXPECTANCY OF A ROTARY SLIDING VANE PUMP

(75) Inventor: Timothy H. Henderson, 2041 Cullen Rd., Gibsonville, NC (US) 27249

(73) Assignee: Timothy H. Henderson, Gibsonville, NC (US)

( * ) Notice: Subject to any disclaimer, the term of this patent is extended or adjusted under 35 U.S.C. 154(b) by 0 days.

(21) Appl. No.: 10/121,126

(22) Filed: Apr. 11, 2002

(65) Prior Publication Data

US 2002/0110467 A1 Aug. 15, 2002

Related U.S. Application Data

(63) Continuation-in-part of application No. 09/767,763, filed on Jan. 23, 2001, now Pat. No. 6,450,789.

(51) Int. Cl.[7] ..... F01C 21/00
(52) U.S. Cl. ..... 418/2; 418/180; 418/268
(58) Field of Search ..... 418/2, 180, 268

(56) References Cited

U.S. PATENT DOCUMENTS

| | | | | |
|---|---|---|---|---|
| 706,158 A | | 8/1902 | Charles | |
| 2,781,000 A | * | 2/1957 | Thomas et al. | 418/252 |
| 3,036,527 A | * | 5/1962 | Peterson | 418/252 |
| 3,102,493 A | * | 9/1963 | Davin | 418/268 |
| 3,191,852 A | | 6/1965 | Kaatz et al. | |
| 3,301,194 A | | 1/1967 | Brunson | |
| 3,398,884 A | | 8/1968 | Kaatz et al. | |
| 3,463,384 A | * | 8/1969 | Kilbane | 418/2 |
| 3,469,500 A | | 9/1969 | Lutz et al. | |
| 3,552,895 A | | 1/1971 | Bayley | |
| 3,565,558 A | | 2/1971 | Tobacman | |
| 4,804,317 A | | 2/1989 | Smart et al. | |
| 4,820,140 A | | 4/1989 | Bishop | |
| 5,318,409 A | | 6/1994 | London et al. | |
| 5,720,598 A | | 2/1998 | de Chizzelle | |
| 6,318,147 B1 | | 11/2001 | Steinruck et al. | |
| 6,368,066 B2 | | 4/2002 | Aiyama et al. | |

FOREIGN PATENT DOCUMENTS

| | | | |
|---|---|---|---|
| AT | 53868 | * 6/1912 | 418/268 |
| AU | 626762 | * 10/1991 | 418/252 |
| DE | 3321380 | * 12/1984 | 418/2 |
| FR | 2596107 | * 9/1987 | 418/180 |

OTHER PUBLICATIONS

Fruitland Tool and MFG., Fruitland Vacuum Pump Operation and Maintenance Manual, Stoney Creek, ON, Canada, including drawings dated 1978 to 2002. Accessed at www-.fruitland–mfg.co on Sep. 9, 2003. See p. 5.

Mannesmann–Demag, Instruction Manual and Spare Parts List for Air–Cooled Rotary Compressors and Vacuum Pumps, Nr. BE 10/1982/3US, 1982, Schopfheim, Germany. See p. 14.

Blackmer, Blackmer Rotary Vane Compressors Installation, Operation and Maintenance Instructions, Model:E56, E106, E156, Oct. 1999, Grand Rapids, MI, USA. See pp. 7–8.

* cited by examiner

*Primary Examiner*—Thomas Denion
*Assistant Examiner*—Theresa Trieu
(74) *Attorney, Agent, or Firm*—Adams Evans P.A.

(57) ABSTRACT

The present invention is directed to an apparatus for determining vane wear in rotary sliding vane pumps that operate using slideable vanes, while the pump is in operation. The invention includes a structure that allows a predetermined amount of leakage from a pumping chamber after a predetermined amount of vane length is worn away. The leakage produces a decrease in pump efficiency that is indicated by an indicating device. The indicating device serves to warn that an amount of vane wear has occurred that indicates pump inspection is warranted. The invention also includes a view port formed in the pump housing to allow inspection of the vanes without having to disassemble the pump.

1 Claim, 6 Drawing Sheets

APPARATUS FOR INDICATING REMAINING LIFE EXPECTANCY OF A ROTARY SLIDING VANE PUMP

RELATED APPLICATIONS

The present application is a continuation-in-part of U.S. patent application Ser. No. 09/767,763 filed Jan. 23, 2001, U.S. Pat. No. 6,450,789, which is hereby incorporated by reference and priority under 35 U.S.C. §120 is hereby claimed.

FIELD OF THE INVENTION

The present invention relates to rotary vane pumps having self-lubricating sliding vanes. More particularly, the present invention is directed to an apparatus for indicating remaining life expectancy of a rotary sliding vane pump to a user while the pump is in normal operation.

BACKGROUND OF THE INVENTION

Rotary vane pumps having self-lubricating sliding vanes have been used for several years for a multitude of mechanical and industrial applications and are exposed to a wide range of environmental conditions. These pumps can be used in both gas and liquid pumping applications. One type of rotary sliding vane pump is a dry air pump. In the general aviation field prior to the early 1960's, pumps that were lubricated by oil drove the vacuum systems that powered gyros. These types of pumps were referred to in the art as wet pumps. In the 1960's, the oil lubricated, or wet vane vacuum pumps, were replaced by dry vacuum pumps having carbon vanes and rotors that were self-lubricating. Presently, standard dry vacuum pumps in the market comprise mechanical carbon rotors and vanes operating in a hardened metal ellipsoidal cavity. These pumps provide a power source for, among other things, gyroscopically controlled, pneumatically operated flight instruments.

A dry air type rotary vane pump has a rotor with radially extending slots with respect to the rotor's axis of rotation, vanes that reciprocate within these slots, and a chamber contour within which the vane tips trace their path as they rotate and reciprocate within their rotor slots. The reciprocating vanes thus extend and retract synchronously with the relative rotation of the rotor and the shape of the chamber surface in such a way as to create cascading cells of compression and/or expansion, thereby providing the essential components of a pumping machine.

Certain parts of these pumps can be made of carbon or carbon graphite. These parts rub against other stationary or moving parts of the pump during operation. Graphite from these parts is deposited on the opposing parts by the rubbing action and forms a low friction film between the parts, thereby providing lubrication. The deposited graphite film is itself worn away by continued operation of the pump, and is eventually exhausted out of the pump. The film is replaced by further wear of the carbon graphite parts. Thus, lubrication is provided on a continuous basis that continuously wears away the carbon graphite parts. The pump vanes require and provide the majority of lubrication. Therefore, the vanes wear and lose length as the pump operates. At some point in time, the length of the vanes will become so short that they will not slide properly in the slot, which may lead to pump failure.

Failure of a dry air pump while in service can render one or more aircraft systems inoperative. In addition, most pump failures occur in flight. Dry air pump performance is generally unaffected by wear on the vanes until total failure. Moreover, pump efficiency does not typically degrade enough to be noticed by the pilot until total failure. Usually, pump operation is monitored based on the aircraft's vacuum gauge. If the pump is not operating correctly, the vacuum gauge will indicate such. However, this generally does not occur until near complete failure of the pump.

Previous dry air pump designs typically operate until failure occurs with little deterioration in pumping performance. In other words, the pumping efficiency remains high until actual failure occurs. As a result, indicators in the cockpit indicate, "ok" until the pump fails. Typically, there is no warning in the cockpit that the wear state of the vanes is such that failure can be expected in the reasonably foreseeable future life of the pump. Such a warning is not currently available in the industry.

Occasionally aircraft dry air pumps do wear to the point that performance deteriorates sufficiently to show on a cockpit indicator prior to failure. However, such cases are anomalies. The present state of the art provides lights, gages, etc. in the cockpit to indicate pump failure, after the fact. Except for those rare occasions in which pump wear progresses to such an advanced state prior to failure that pump performance deteriorates, they do not provide information relative to the wear state of the pump or a warning of likely pump failure.

Improved economics for aircraft operations may be achieved through the ability to schedule the replacement of a pump rather than have a pump fail unexpectedly. At present, the only method of reducing the likelihood of unexpected failure is to replace a pump with a serviceable one at an early stage of its life. This "arbitrary" replacement is wasteful.

Characteristically, dry air pump performance is little affected by vane wear until the time of failure, at which time performance collapses totally and instantly. Even though the vanes may have reached a very advanced state of wear prior to failure, efficiency typically does not degrade substantially. What loss of performance that does occur is not typically sufficient to be detected on an aircraft's vacuum gage or other normal cockpit indicators. Thus, the pilot has no warning of an imminent air pump failure.

A correlation exists between the remaining length of the vanes and the expected future operational life of the pump. It has been shown that the incidence of structural failure of the vane/rotor combination begins to increase appreciably after the vanes wear to a certain length. The rate of failure per unit of time increases dramatically as the vanes continue to wear shorter.

When the vane length is equal to approximately 74% or more of its original length, failure due to mechanical malfunction arising from reduced vane length is unlikely. (It may occur in pumps operated at excessive pressure/vacuum, but typically does not occur in normally loaded pumps). The total failure rate (from all causes) for pumps with vanes having remaining lengths greater than 74% is less than approximately 5% of the operating population. Other modes of failure unrelated to vane length might occur at any time during the pump's life.

By the time vane length reaches 68% of original length, about 50% of installed pumps may have failed. More than 90% of those failures are likely to have been caused by mechanical malfunction relating to vane length. By the time vane length falls below 64% of original length, more than 98% of installed pumps may have failed, more than 95% of those failures are related to vane length.

While vane wear occurring as a result of deposition of graphite for lubrication is normal, fairly predictable, and reasonably slow, vane wear is accelerated by operation of carbon graphite parts against roughened interior surfaces of the pump. Such roughness can occur as the result of operating the pump in a harsh environment, with dirty filters, at elevated temperatures or pressures (vacuums), or for a variety of other reasons. Regardless of whether the vanes became worn "normally" at a normal rate, or "abnormally" at an accelerated rate, when the vanes reach the critical length, the likelihood of pump failure increases dramatically. That is to say, regardless of the number of hours of operation, when the vanes wear to a certain length, the likelihood of failure increases dramatically.

Upon rotation of the rotor, the space between each pair of vanes forms a pumping chamber that intakes, compresses, and exhausts air at appropriate points in rotation. For the pump to be efficient, there must be little internal leakage between the individual pumping chambers or the chambers of higher or lower air pressure.

The vanes fit closely in the rotor slots and are fitted closely to the inside of the pumping chamber to prevent the transfer of air from the chamber formed ahead of a vane to the chamber behind the vane. The close fitted vanes prevent transfer of air from or to the exhaust or inlet plenum of the pump, or from the atmosphere, to a chamber of higher or lower pressure. Air leakage from one chamber to the next introduces inefficiency. The pump's output in volume, or pressure (vacuum), or both, deteriorates as a result of the inefficiency.

The nature of the wear and the loading of the parts of the pump normally prevents excess internal leakage, even when the vanes are severely worn away, and even up to the point of imminent failure. However, if "leaks" were introduced between chambers, and those leaks would only occur after the vanes reached a predetermined length, a slow degradation of the pump's performance could be caused, beginning at a predictable time prior to likely failure. The time selected (actually a function of vane length) could be sufficiently early in the pump's life to help insure that the pump was inspected and replaced (if necessary) prior to the vanes reaching an excessive state of wear.

The present invention provides a modification to a rotary pump to introduce deteriorating pumping efficiency as the vane length wears. The deteriorated performance is sufficient and rapid enough to be observed on cockpit indicators, or indicators mounted in other places.

SUMMARY OF THE INVENTION

In view of the foregoing, it is an object of the present invention to provide an improved way to determine the remaining useful life of a rotary sliding vane pump without having to disassemble the pump to make that determination. More particularly, it is an object of the present invention to provide a way to provide to a user an indication that the vanes within rotary pumps have reached a predetermined length, thereby notifying the user of the remaining life expectancy of the pump.

It is a further object of the present invention to provide a physical modification to a rotary pump, in either the rotor or one or more vanes that will introduce a leakage between pumping chambers. The leakage is in an amount that will deteriorate pump efficiency to such an extent that a user may recognize pump wear, but will not adversely affect pump operation.

To achieve these and other advantages the invention provides for a rotary sliding vane pump, having a housing containing a bore forming an interior wall, an inlet port, and an outlet port. A pumping apparatus is provided that includes a rotor that is rotatably mounted within the bore. The rotor has a plurality of circumferentially spaced, radially extending slots formed therein. An equal number of vanes of a predetermined length are slideably positioned within the slots. A drive attachment is coupled to the rotor to rotationally drive the rotor in the bore thereby urging the vanes radially outwardly and into engagement with the wall to form at least one pumping chamber. One or more leakage ports are formed in the pumping apparatus in a manner such that when vane length degrades to a predetermined point, the leakage port is opened between the pumping chamber under pressure and the remaining pump housing. Air in the pumping chamber will leak through the port, thereby introducing a controlled drop in pump efficiency that can be indicated on existing control instrumentation, or dedicated pump efficiency instrumentation, viewable to a user. A viewport may also be formed in an end of the housing. The viewport is positioned relative to the slots and the vanes to allow a determination of vane length for each vane when the vane is in engagement with the wall.

Other objects and advantages of the invention will be apparent from the description of the preferred embodiments or may be learned by practice of the invention.

BRIEF DESCRIPTION OF THE DRAWINGS

In order that the invention will become more dearly understood it will be disclosed in greater detail with reference to the accompanying drawings, in which.

DESCRIPTION OF THE PREFERRED EMBODIMENT

Figure 1:
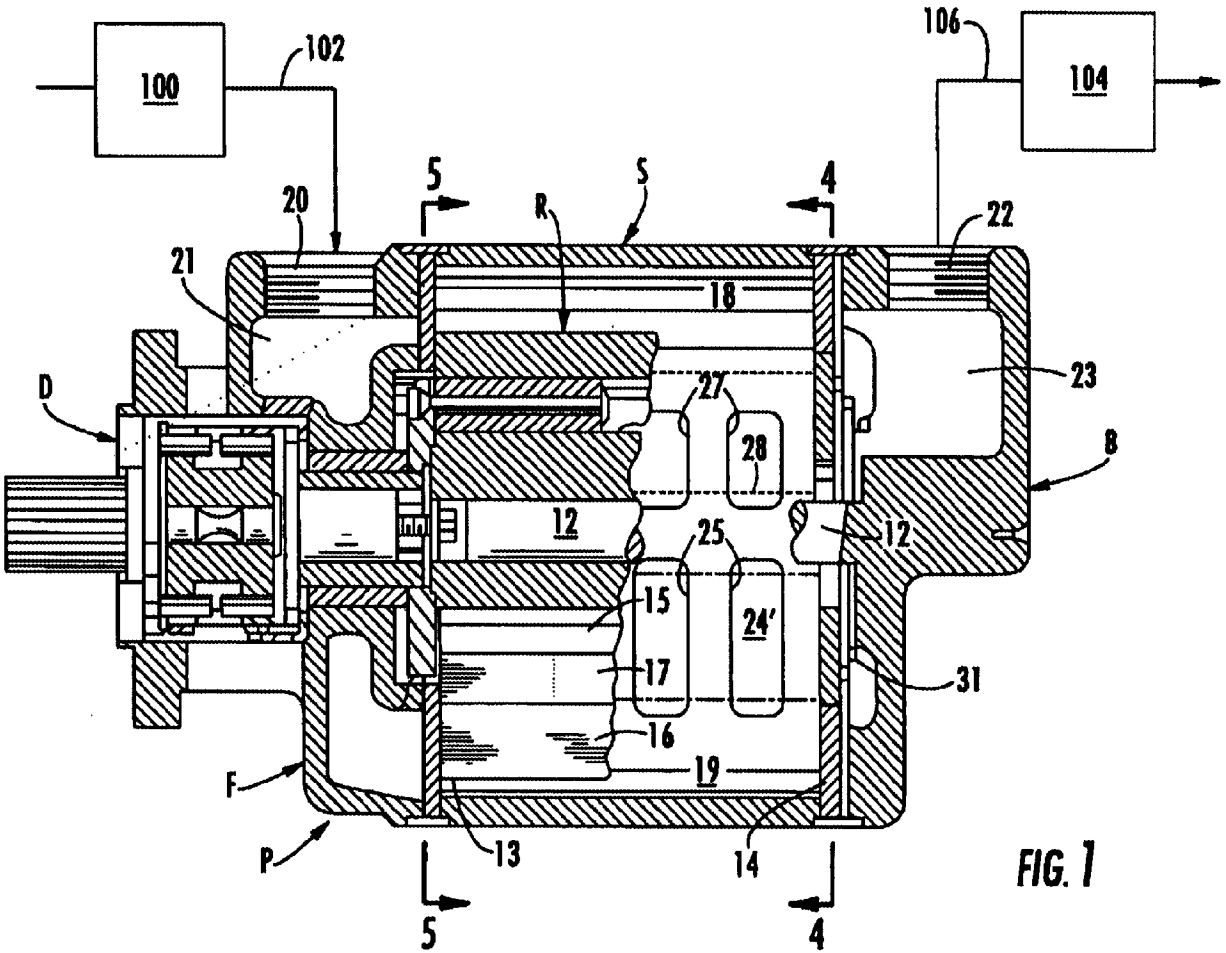
FIG. 1 is a longitudinal sectional view through the centerline of a rotary sliding vane pump.

FIGS. 1 through 4 illustrate the type of vane monitoring apparatus shown in the parent application Ser. No. 09/767,763, U.S. Pat. No. 6,450,789. FIG. 1 illustrates a rotary vane pump suitable for the present invention. As illustrated in FIG. 1, rotary vane pump P has a central annular body or stator S, a rotor R, a front flange F secured to an inlet end of stator S, a back flange B secured to the outlet end of stator S, and a drive assembly D mounted on front flange F for driving rotor R.

Figure 2:
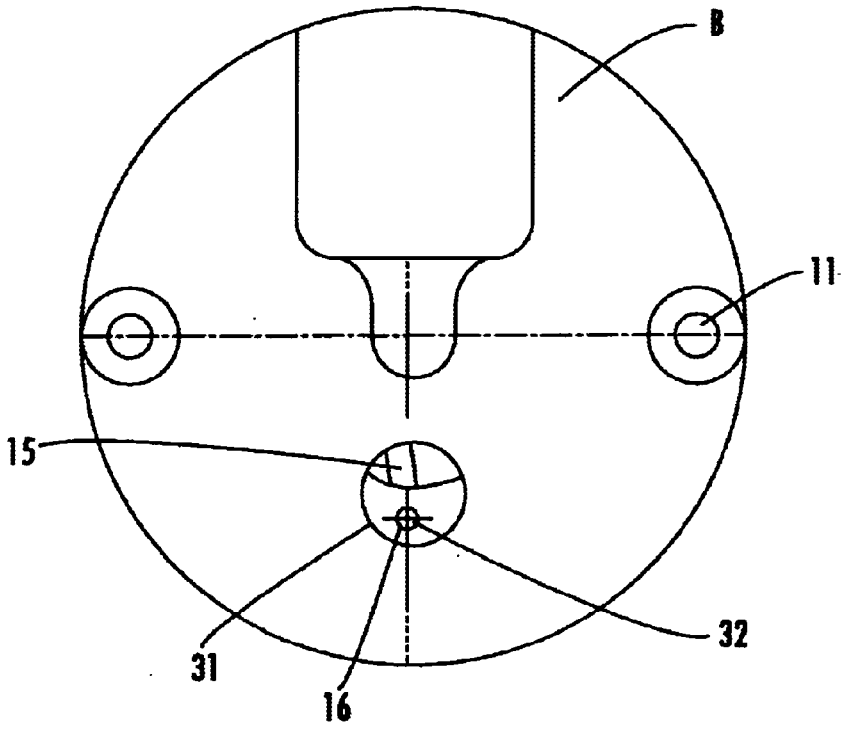
FIG. 2 is an end elevation view of the rear flange including a view port according to an embodiment of the invention.

Front flange F and back flange B can be secured to stator S by any known type of securing device as long as the pump parts S, F, and B are securely held in place during operation. Preferably, back flange B and front flange F are mounted to stator S such as with screws 10 (FIG. 2).

Back flange B is provided with a central stud 12 that extends into and at least partially through stator S to provide a journal for rotor R. The forward end of rotor R rests against an inlet plate 13 of annular form interposed between front flange F and stator S. The opposite end of stator S rests against a floating end plate 14 interposed between stator S and back flange B. Alternatively, back flange B can be secured directly to stator S without interposing an intermediate end plate.

Rotor R has a central bore that receives central stud 12, and which provides a bearing surface for rotary movement of rotor R about its central axis. In the illustrated embodiment, rotor R is provided with six circumferentially spaced vane slots 15 that are angled slightly from a radial direction, and extend over the entire longitudinal length of rotor R. Each slot 15 receives a vane 16, which slides in and out of slot 15 as rotor R is rotationally driven about its center axis.

Each of vanes 16 is preferably made from a material that, during use, wears and produces a form of dry lubrication for the pump P. For example, vanes 16 can be made from, but is not limited to carbon material, graphite, and various organic binders. A self-lubricating coating may be applied to the pump parts to inhibit wear between the vanes 16 and pump rotor R. In addition, each vane 16 can be provided with a metal jacket 17 to enhance strength. Jacket 17 is not essential to the present invention, however.

Figure 3:
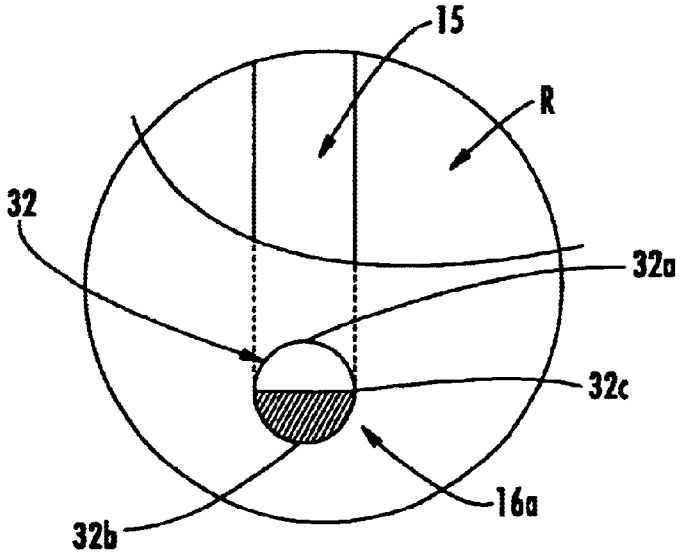
FIG. 3 is an enlarged view of the view port of FIG. 2.
Figure 4:
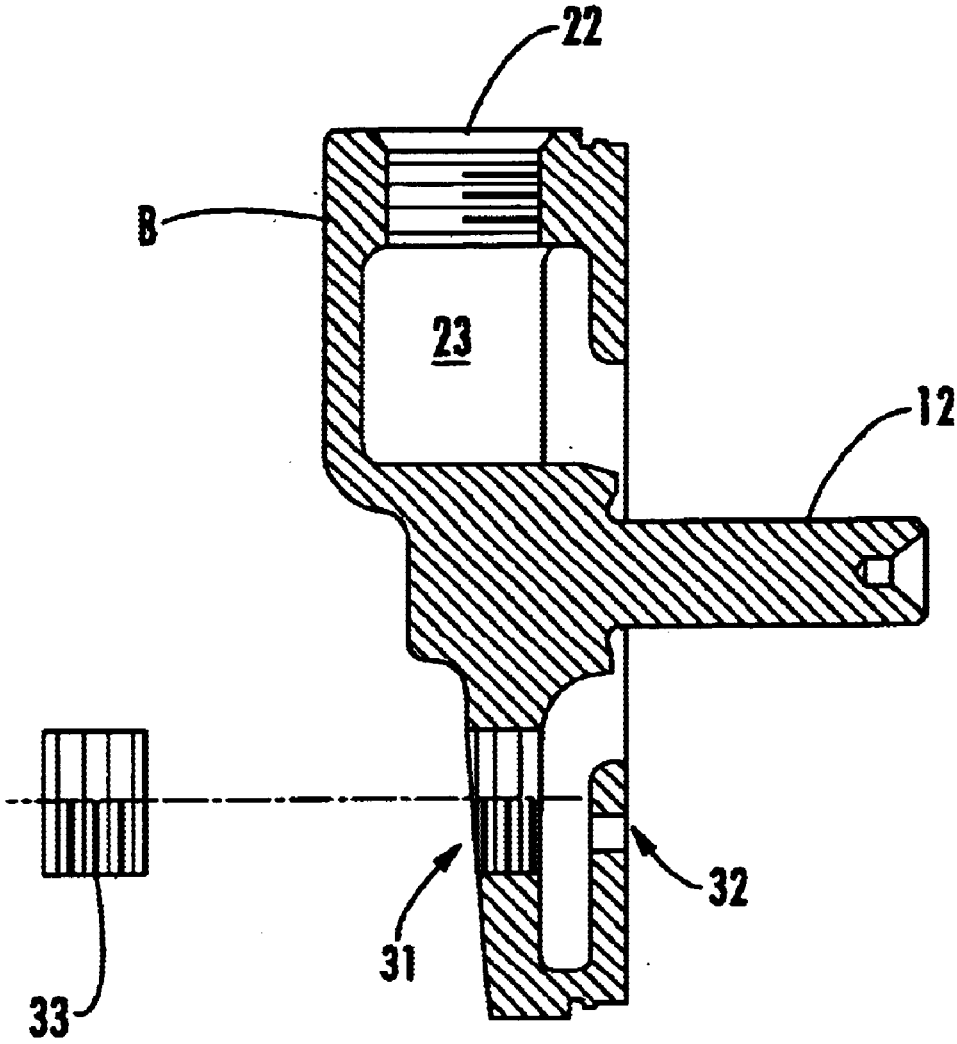
FIG. 4 is a side section view of a rear flange of a rotary vane pump illustrating one aspect of the present invention.

As described above, it is desirable to determine the remaining life of the vanes without. having to disassemble the entire pump. As previously described in the parent application, Ser. No. 09/767,763, U.S. Pat. No. 6,450,789 FIGS. 2, 3, and 4 illustrate a preferred embodiment of a back flange B provided with a viewport 31 and a calibrated or gauge hole 32 through which the inboard edge of vane 16 can be seen under certain circumstances. Calibrated hole 32 is located such that after the pump has been operated for a predetermined number of hours, for example 800 hours, there is a high probability that the inboard edges of pump vanes 16 will be observable in hole 32, one-by-one as the rotor is turned and the pump is oriented for observation. The observation may find the inboard edge of vane 16 in an "upper" portion 32*a* (closest to the center of rotation of the rotor R) of calibrated hole 32, midway in the hole 32*c*, or at the "bottom" portion 32*b* (farthest from the center of rotation of the rotor R). The edge of vane 16 may not be visible in calibrated hole 32 at all, being above or below the upper or lower edges of hole 32, respectively.

The position of the inboard edge of vane 16 at a known point in the operational life of the pump (e.g.; 800 hours of service) provides useful information as to the present state of wear of the vanes and the rate of wear up to that time. If the inboard edge of vane 16 is not visible and has not yet reached upper edge 32*a* of calibrated hole 32, vane 16 has little wear, and the rate of wear, using the 800 hour example, would be considered unusually slow. If the inboard edge of vane 16 is not visible in hole 32 and is below bottom edge 32*b* of calibrated hole 32, the state of wear, again using the 800 hour example, would be very advanced, and the rate of wear to that point would be considered unusually rapid. In such a case, pump P should be replaced and removed from service. If the inboard edge of vane 16 appears in the approximate center 32*c* of calibrated hole 32 as shown in FIG. 3, wear of vane 16 and rate of wear are probably within normal limits. When the vane inboard edge appears in the approximate center of hole 32, an additional 200 hours of wear, under normal operating conditions, should be expected until the inboard edge of the vane appears adjacent to bottom 32*b* of the hole. When the inboard edge of the vane reaches the bottom of hole 32, replacement of pump P is warranted.

The diameter of calibrated hole 32 should be approximately equal to the reduction of length of vane 16 after about 400 hours of use under normal operating conditions. Thus, when the inboard edge of vane 16 appears at the top 32*a* of calibrated hole 32, an additional 400 hours of pump use should be expected under normal wear conditions on the vane. Accordingly, periodic observation of the position of the vane inboard edge in calibrated hole 32 can help in determining the rate of wear of a vane, and by inference, the wear state, rate of wear of pump P, and the remaining useful life of pump P.

The radial location of calibrated hole 32 should be selected to permit observation of each of vanes 16, one-by-one, as the rotor R is turned and when vane 16 is at a point of maximum extension in slot 15, i.e., when the leading edge of vane 16 is in contact with the wall of stator S. The position correlates with a segment of the pump stator's curve where vane extension is constant. Other radial locations of calibrated hole 32 may introduce significant errors. The distance from the rotor's centerline of rotation (and the pump's rotational centerline) correlates to a certain vane inboard edge position expected after a particular number of hours of operation at a normal wear rate. The diameter of calibrated hole 32 corresponds to an expected amount of vane length wear over a period of time. That is, as the vane length decreases during pump use, the inboard vane edge will move radially outwardly in slot 15.

As shown in FIG. 4, visual access to calibrated hole 32, which is located in the inner wall of the pump's back flange B, is gained by removing a cover, such as a threaded plug 33, from a larger viewport 31 on the outside wall of back flange B. Plug 33 is preferably made from aluminum and is threaded in such a way that once tightened into viewport 31, plug 33 will be locked into position and will not require any additional locking mechanism. Aluminum is the preferred material for plug 33 because its coefficient of thermal expansion is the same as back flange B of pump P, which is generally some form of anodized aluminum. This prevents undesirable strains and stress on back flange B during pump operation. Plug 33 is preferably coated with a corrosion preventing material, and the corresponding threaded hole in back flange B should also be treated to prevent galling between the two aluminum parts when assembled. Use of dissimilar metals for plug 33 and back flange B to prevent galling and overstraining the assembly when removal plug 33 is required could add weight or induce dissimilar metal corrosion or/and could induce undesirable stress through unequal coefficients of thermal expansion. The present inventive combination ensures weight reduction and avoidance of undesired stress. Furthermore, corrosion can be avoided through the use of innovative combinations of materials, treatments and thread design.

Figure 5:
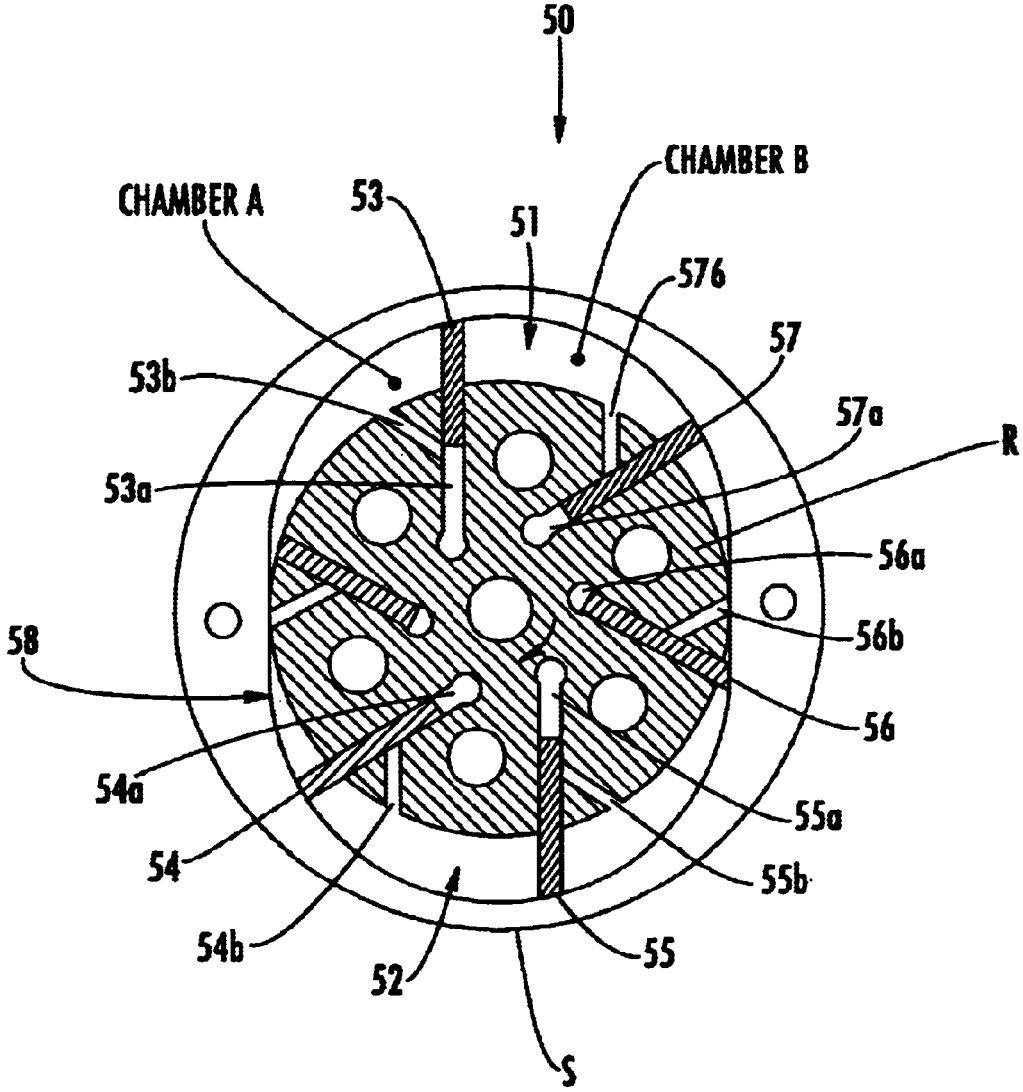
FIG. 5 is a transverse section view of a rotary vane pump according to a second embodiment of the present invention.
Figure 6:
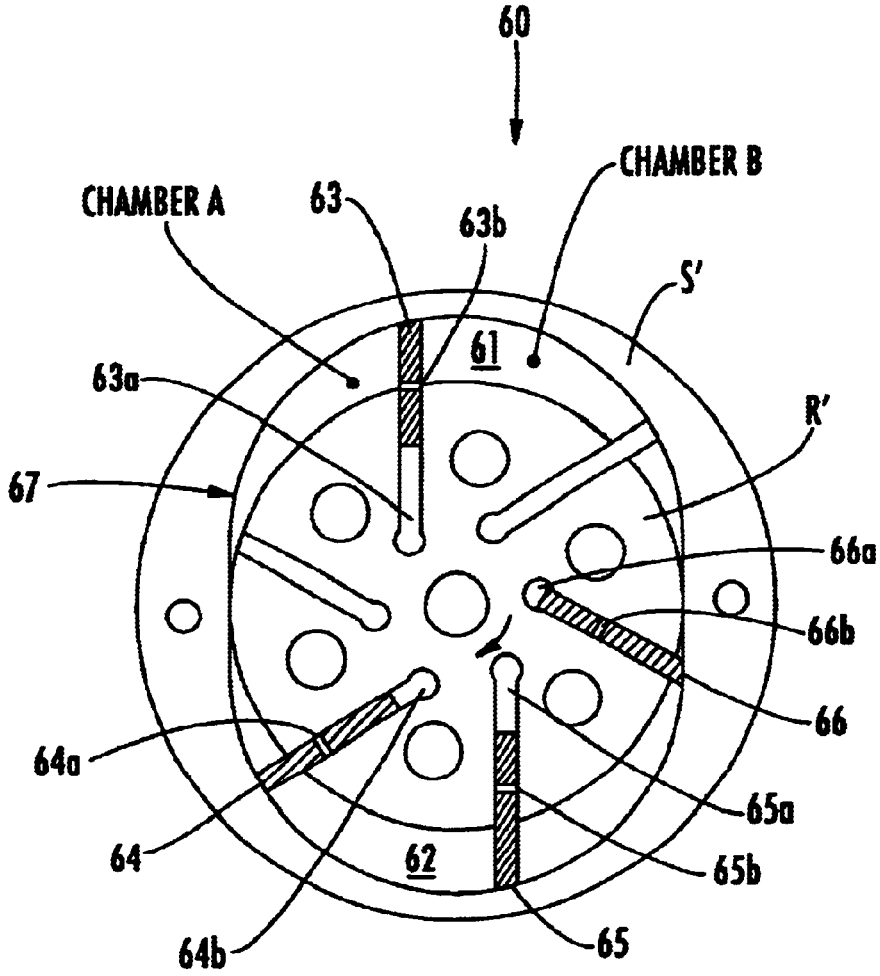
FIG. 6 is a transverse section view of a rotary vane pump according to a third embodiment of the present invention.
Figure 7:
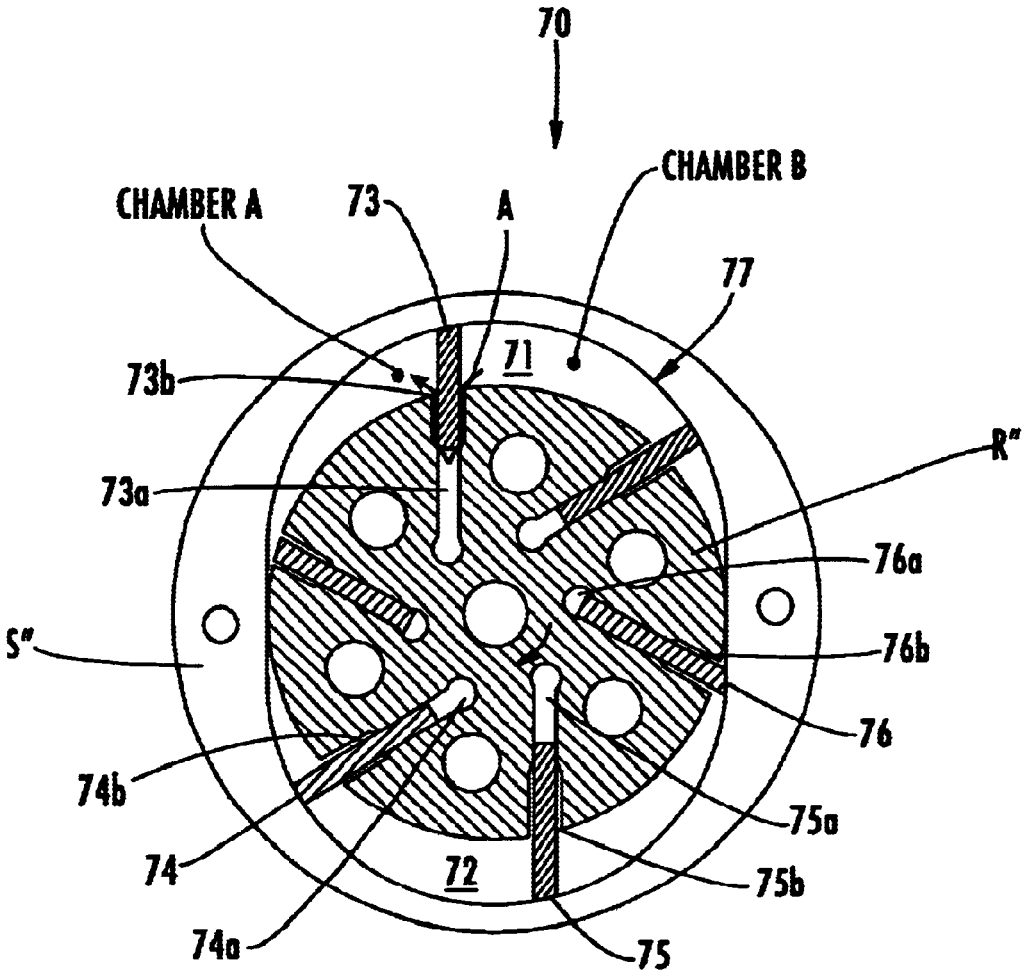
FIG. 7 is a transverse section view of a rotary vane pump according to a fourth embodiment of the present invention.

While the above-described viewport 31 is advantageous to inspect and determine remaining life expectancy of a rotary sliding vane pump, the inspection can only be done when the pump is not operating. The present invention provides an apparatus that provides a warning that vane wear of the pump is reaching a certain point while the pump is operating. FIGS. 5, 6, and 7 illustrate alternative embodiments of this aspect of the invention.

Referring to FIG. 5, stator S of pump 50 is provided with two symmetrically opposite lobes 51 and 52, the surfaces of which act as cams that regulate the two extension and retraction cycles for vanes 53 through 57 during each rotation of rotor R. Each vane 53 through 57 slides within a respective slot 53*a* through 57*a* formed in rotor R. As rotor R rotates in a clockwise direction, vane 53 slides outwardly in slot 53*a* until it engages the inner stator wall 58 of stator S. Vanes 54 through 57 similarly slide outwardly in respective slots 54*a* through 57*a*. In FIG. 5, vanes 54 through 57 are illustrated as new vanes having little wear. Vane 53 is illustrated as having substantial wear thereto.

Referring to vane 53, two pumping chambers, chamber A and chamber B, are formed between inner stator wall 58 and vane 53. Chamber A is an inlet chamber at low pressure, and chamber B is a pumping chamber beginning to compress incoming air. Thus, chamber B can be said to be at high pressure.

Rotor R is further provided with holes 53*b* through 57*b* drilled therethrough to connect inlet (low pressure) chamber A with an exhaust plenum (item 23, see FIG. 1) of pump P via the drilled passageway through a rotor segment. Holes 53*b* through 57*b* are disposed in fluid communication with the openings shown just above and below the central stud 12 of the back flange B of the pump P in FIG. 1, which openings are in fluid communication with the exhaust plenum 23. The exhaust plenum interconnects chamber A and chamber B. When vanes 53 through 57 have little to no wear, even when fully extended in respective slots 53*a* through 57*a*, the vane length is sufficient to cover respective holes 53*b* through 57*b*. In FIG. 5, vanes 54*a* through 57*a* have little wear and as each extends in its respective slot 54*a* through 57*a*, holes 54*b* through 57*b* remain covered. However, vane 53, which is illustrated as being significantly worn, has extended far enough in slot 53*a* so that hole 53*b* is uncovered. Since hole 53*b* is uncovered, air leakage occurs from pumping chamber B. This leakage from the pumping chambers reduces pumping efficiency by at least partially equalizing pressure between the chambers.

FIG. 6 illustrates an alternative embodiment of the present invention. FIG. 6 illustrates a rotary pump 60 having 6 rotor slots. However, for the sake of brevity only 4 slots are discussed herein. It should be recognized that absent vane length, the remaining structure is substantially identical. FIG. 6 illustrates stator S' provided with two symmetrically opposite lobes 61 and 62, the surfaces of which act as cams that regulate the two extension and retraction cycles for the vanes 63 through 66 during each rotation of rotor R'. Each vane 63 through 66 slides within a respective slot 63*a* through 66*a* formed in rotor R'. As rotor R' rotates in a clockwise direction, vane 63 slides outwardly in slot 63*a* until it engages the inner stator wall 67 of stator S'. Vanes 64 through 66 similarly slide outwardly in respective slots 64*a* through 66*a*. In FIG. 6, vanes 64 through 66 are illustrated as relatively new vanes having little wear. Vane 63 is illustrated as having substantial wear thereto.

Referring to vane 63, two pumping chambers, chamber A and chamber B, are formed between the inner stator wall 67 and vane 63. Chamber A is an inlet chamber at low pressure, and chamber B is a pumping chamber beginning to compress incoming air. Thus, chamber B can be said to be at high pressure. Vane 63 includes hole 63*b* drilled therethrough. Vanes 64 through 66 have similar holes 64*b* through 66*b* drilled therethrough.

Vanes 64 through 66 have little to no wear, even when fully extended in respective slots 64*a* through 66*a*. Therefore, the vane length is sufficient to cover respective holes 64*b* through 66*b*. However, vane 63, which is illustrated as being significantly worn, has extended far enough in slot 63*a* so that hole 63*b* is uncovered. Since hole 63*b* is uncovered, air leakage occurs between the pumping chambers. The communication between chamber A and chamber B reduces pumping efficiency by at least partially equalizing pressure between the chambers.

FIG. 7 illustrates another embodiment of the present invention. FIG. 7 illustrates a rotary pump 70 having 6 vanes and rotor slots, however, for the sake of brevity only 4 vanes and slots are discussed herein. It should be recognized that absent vane length, the remaining structure is symmetrical. FIG. 7 illustrates stator S" provided with two symmetrically opposite lobes 71 and 72, the surfaces of which act as cams that regulate the two extension and retraction cycles for the vanes 73 through 76 during each rotation of rotor R". Each vane 73 through 76 slides within a respective slot 73*a* through 76*a* formed in rotor R". As rotor R" rotates in a clockwise direction, vane 73 slides outwardly in slot 73*a* until it engages the inner stator wall 77 of stator S". Vanes 74 through 76 similarly slide outwardly in respective slots 74*a* through 76*a*. In FIG. 7, vanes 74 through 76 are illustrated as relatively new vanes having little wear. Vane 73 is illustrated as having substantial wear thereto.

Referring to vane 73, two pumping chambers, chamber A and chamber B, are formed between the inner stator wall 77 and vane 63. Chamber A is an inlet chamber at low pressure, and chamber B is a pumping chamber beginning to compress incoming air. Thus, chamber B can be said to be at high pressure. In this embodiment, slot 73*a* includes an enlarged slot area 73*b* extending a predetermined length into slot 74*a*. Vanes 74 through 76 have similar enlarged slot areas 74*b* through 76*b* formed therein.

Vanes 74 through 76 have little to no wear, even when fully extended in respective slots 74*a* through 76*a*. Therefore, the vane length is sufficient to extend into their respective slots enough to seal the enlarged slot areas 74*b* through 76*b*. However, vane 73, which is illustrated as being significantly worn, has extended far enough in slot 73*a* so that enlarged slot area 73*b* is uncovered. Since enlarged slot area 73*b* is uncovered, air leakage occurs between the pumping chambers as illustrated by arrow A. The communication between chamber A and chamber B reduces pumping efficiency by at least partially equalizing pressure between the chambers.

In each of the above described embodiments, there is introduction of a controlled progressive leak between at least one pumping chamber and an atmosphere of higher or lower pressure. In each embodiment, the structure that allows leakage is formed under a predetermined specification so as to allow leakage after a predetermined amount of vane wear occurs. Thus, the point in the pump's life at which lower efficiency will occur, or begin to occur, can be predicted with a degree of accuracy. Furthermore, the pumping efficiency of the pump will be compromised only enough by the leak to be detectable via cockpit indications, visually, audibly, electrically, electronically, or otherwise. The rate of progression of the leak is such that sufficient time exists between its onset and the time the system falls out of serviceable range to permit continued safe operation of the aircraft until arrangements for replacement of the pump can be made.

Various means for displaying the pump's efficiency, which typically involve measuring the pump's pressure output, are known. For example, as discussed above, the aircraft may include a gauge which measures the pressure (either above or below atmospheric pressure) in a conduit connected to the pump, or a pressure actuated switch preset to close a warning light circuit may be connected to the pump. Display means such as those described above are depicted schematically in FIG. 1. Display means 100 are connected to an inlet conduit 102 which is in turn connected to the pump inlet port 20. If the pump is used as a pressure pump, display means 104 could alternatively be connected an outlet conduit 106 which is in turn connected to the pump outlet port 22.

The above detailed description of the invention embodiments sets forth the best mode contemplated by the inventor for carrying out the invention at the time of filing this application and is provided by way of example and not as a limitation. Accordingly, various modifications and variations obvious to a person of ordinary skill in the art to which it pertains are deemed to lie within the scope and spirit of the invention as set forth in the following claims.

What is claimed is:

1. A rotary sliding vane pump, comprising:

(a) a housing containing a bore forming an interior wall, an inlet port, and an outlet port;

(b) a pumping apparatus rotatably mounted within the bore, the pumping apparatus comprising a rotor having a plurality of circumferentially spaced, radially extending slots formed therein, an equal number of vanes of a predetermined length slideably positioned within the slots;

(c) a drive attachment coupled to the pumping apparatus to rotationally drive the rotor in the bore thereby urging the vanes radially outwardly and into engagement with the interior wall to form at least one pumping chamber;

(d) one or more leakage ports formed at a position in the pumping apparatus so as to allow leakage of air in the one or more pumping chambers through the one or more leakage ports after a predetermined amount of vane length wears, said predetermined amount of vane length being chosen such that a substantial amount of vane length remains for continued operation of said pump, and wherein said leakage does not substantially reduce the performance of said pump, wherein the one or more leakage ports are formed as an enlarged section at an open end of at least one of said slots, wherein the enlarged section extends inwardly in the slots to a point where after a predetermined amount of vane length wear occurs, an open passage is formed between the at least one pumping chamber and an adjacent pumping chamber; and (e) means for displaying decreasing efficiency of the rotary vane pump as air leaks from the at least one pumping chamber.

* * * * *